US006874779B2

(12) United States Patent
Park

(10) Patent No.: US 6,874,779 B2
(45) Date of Patent: Apr. 5, 2005

(54) PAPER SEPARATING GUIDE OF PAPER FEEDING CASSETTE FOR PRINTING

(75) Inventor: Gyeong-ho Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/426,798

(22) Filed: May 1, 2003

(65) Prior Publication Data

US 2004/0026845 A1 Feb. 12, 2004

(30) Foreign Application Priority Data

Aug. 7, 2002 (KR) ..... 2002-46655

(51) Int. Cl.[7] ..... B65H 3/34; B65H 3/52
(52) U.S. Cl. ..... 271/121; 271/167
(58) Field of Search ..... 271/121, 167

(56) References Cited

U.S. PATENT DOCUMENTS 6,139,007 A * 10/2000 Cahill et al. ..... 271/121
6,536,757 B2 * 3/2003 Chang ..... 271/16

FOREIGN PATENT DOCUMENTS

| | | | |
|---|---|---|---|
| JP | 60-148740 | 10/1985 | |
| JP | 10-181912 | * 7/1998 | ..... B65H/3/52 |
| JP | 2000-168980 | 6/2000 | |
| JP | 2001-106370 | 4/2001 | |
| JP | 2001-322732 | * 11/2001 | ..... B65H/3/52 |
| JP | 2002-173239 | 6/2002 | |
| JP | 2002-517364 | 6/2002 | |
| JP | 2004-26369 | 1/2004 | |

* cited by examiner

*Primary Examiner*—Donald P. Walsh
*Assistant Examiner*—Kenneth W Bower
(74) *Attorney, Agent, or Firm*—Staas & Halsey LLP

(57) ABSTRACT

A paper separating guide of a paper feeding cassette for a printing apparatus in which a picking error does not occur when a thick printing paper is stacked in a cassette. In the paper separating guide, a surface friction coefficient varies depending on a position of the printing papers. The friction coefficient is linearly varied depending on the contact position.

31 Claims, 4 Drawing Sheets

PAPER SEPARATING GUIDE OF PAPER FEEDING CASSETTE FOR PRINTING

CROSS-REFERENCE TO RELATED APPLICATIONS

This application claims the benefit of Korean Application No. 2002-46655, filed Aug. 7, 2002, in the Korean Intellectual Property Office, the disclosure of which is incorporated herein by reference.

BACKGROUND OF THE INVENTION

1. Field of the Invention

The present invention relates to a printing apparatus which feeds a printing paper using a paper feeding cassette, and in particular, to a printing apparatus which uses a dam type paper feeding cassette in such a manner that a printing paper is separated and fed using a paper separating guide.

2. Description of the Related Art

Generally, a printing apparatus such as an ink jet printer, laser printer, copy machine, etc., uses a paper feeding apparatus which is capable of continuously printing a plurality of printing papers to implement a continuous printing operation. A dam type paper feeding cassette is used as one type of the continuous paper feeding apparatus. This type of paper feeding cassette uses a paper separating guide. FIG. 1 is a view illustrating an example of a paper feeding cassette for a dam type printing apparatus.

As shown in FIG. 1, the paper feeding cassette includes a cassette 10, a pick-up roller 30, a picking arm 20 and a paper separating guide 40.

As shown in FIG. 2, the cassette 10 stacks a plurality of printing papers 1 therein and is installed in a body (not shown) of the printing apparatus. A pad 11 is installed in a bottom of the cassette 10 to transfer the last printing paper 3.

The pick-up roller 30 is installed in an upper portion of the cassette 10 and pressurizes the printing papers 1 stacked in the cassette 10 and rotates to thereby transfer the printing papers 1 in a direction of the paper separating guide 40.

The picking arm 20 is installed in such a manner that one end 21 thereof is rotatable with respect to the body of the printing apparatus, and the other end is connected to a shaft of the pick-up roller 30. When the height H of the printing papers 1 stacked in the cassette 10 is changed, since the pick-up roller 30 is rotated with respect to the one end 21 of the picking arm 20, the pick-up roller 30 continuously pressurizes the printing papers 1. The picking arm 20 includes a driving force transferring unit (not shown) that receives a driving force from a driving source (not shown), such as a motor installed in the body, and transfers the received driving force to the pick-up roller 30. Therefore, the pick-up roller 30 is rotatable in a state in which an upper surface of the printing papers 1 is pressurized.

The paper separating guide 40 is installed in the forward part of the cassette 10 and is installed in such a manner that the paper separating guide 40 is inclined in a transferring direction of the printing papers 1. A surface 41 of the paper separating guide 40 has a friction coefficient associated therewith. An uppermost printing paper 2 receives the picking force from the pick-up roller 30, which is greater than the friction force, thereby allowing transfer of the paper 2. The printing papers 1, which are placed below the uppermost printing paper 2 and have a picking force which is smaller than the friction force of the paper separating guide 40, are not transferred over the paper separating guide 40.

The operation of the paper feeding apparatus for the conventional printing apparatus will be described with reference to FIGS. 1 and 2.

When a printing operation begins, a driving force is transferred to the pick-up roller 30 through the picking arm 20. At the same time, the picking arm 20 is rotated downward with respect to an engaging portion of the body of the printing apparatus, and the pick-up roller 30 presses on an upper surface of the uppermost sheet of printing paper 2 of the cassette 10. The engaging portion attaches to the end 21 of the picking arm 20.

Thereafter, the uppermost sheet of the printing paper 2 is transferred to the paper separating guide 40 by the friction force and rotation of the pick-up roller 30. At this time, a plurality of printing papers 1 are transferred in the direction of the paper separating guide 40 by the pick-up roller 30. However, only the uppermost printing paper 2 has a transfer force from the pick-up roller 30 which is larger than a friction force applied by the paper separating guide 40. Thus, only the uppermost printing paper 2 is transferred to the body of the printing apparatus via the paper separating guide 40. However, since the transferring forces of the printing papers 1 are smaller than the friction force of the paper separating guide 40, the printing papers 1 do not pass through the paper separating guide 40. Therefore, the printing papers 1 stacked in the cassette 10 are separated one by one, and the separated paper is fed to the body of the printing apparatus.

When the printing papers 1 are continuously transferred, the stacking height H of the printing papers 1 is decreased. In this state, the picking arm 20 is rotated downward, so that the pick-up roller 30 maintains close contact with an upper surface of the printing paper 2. In the above manner, the uppermost printing paper 2 is continuously fed to the body of the printing apparatus through the paper separating guide 40.

However, if thick printing papers are stacked to a maximum height H in the cassette 10 and are then printed, a picking error, in which the printing paper 2 is not picked up by the pick-up roller 30, occurs.

The above picking error occurs when the paper transferring force of the pick-up roller 30, namely, the picking force, is smaller than the friction force of the paper separating guide 40.

The above problem will be described in more detail. As shown in the graph of FIG. 3, the transferring force applied to the printing papers 1, namely, the picking force, changes based on the stacked height H of the printing papers 1. However, the friction force applied to the printing papers 1 by the paper separating guide 40 is determined based on a surface friction coefficient of the paper separating guide 40 and the type of paper used. Therefore, if the types of the printing papers 1 are the same, the friction force is the same irrespective of the stacked height H. Line C in FIG. 3 illustrates a friction force of the paper separating guide 40 applied to a thin paper (for example, 60 g/m$^2$). Line B in FIG. 3 illustrates a friction of the paper separating guide 40 applied to a thick paper (for example, 105 g/m$^2$).

As shown in FIG. 3, in the case of the thick printing paper, in a certain portion (portion X) in which the height of the printing papers 1 stacked in the cassette is high, the friction force of the paper separating guide 49 is larger than the picking force of the pick-up roller 30. In this case, a picking error in which the printing paper is not transferred by the pick-up roller may occur.

In order to overcome the above problems, the surface friction coefficient of the paper separating guide 40 can be decreased. However, if the paper is thin or has a lot of static electricity, the uppermost printing paper 2 is not properly separated, and multiple sheets of the printing papers are fed at once. Therefore, it is difficult to employ the paper separating guide 40 in the printing apparatus in which various types of printing papers are used.

SUMMARY OF THE INVENTION

Accordingly, it is an aspect of the present invention to provide a paper separating guide of a paper feeding cassette for a printing apparatus which overcomes the problems encountered in the conventional art.

It is another aspect of the present invention to provide a paper separating guide of a paper feeding cassette for a printing apparatus which is capable of using various types of papers by preventing a picking error when a thick printing paper is fed, and to prevent multiple papers from being fed.

Additional aspects and advantages of the invention will be set forth in part in the description which follows and, in part, will be obvious from the description, or may be learned by practice of the invention.

In order to achieve the above and/or other aspects, in a paper separating guide of a paper feeding cassette for a printing apparatus, a surface friction coefficient is different based on a contact position of an end of a printing paper. A friction coefficient of the paper separating guide differs linearly or step by step based on the contact position.

In addition, a friction coefficient for a paper at the bottom of a cassette is largest. In particular, the minimum value of the friction coefficient is smaller than a force needed to transfer an uppermost printing paper when the maximum amount of the thickest possible printing paper is stacked in the cassette.

Here, the friction coefficient is determined based on heights of protrusions formed on a surface of the paper separating guide.

The foregoing and/or other aspects of the present invention are achieved by providing a paper feeding cassette for a printing apparatus, including a cassette to stack a plurality of printing papers therein; a paper separating guide which is installed in the cassette and has a variable surface friction coefficient based on contact positions of the printing papers; and a pick-up roller which is rotated based on a height of the stacked printing papers, whereby the printing papers are transferred to the paper separating guide by the rotation of the pick-up roller by being separated one by one by a friction between the paper separating guide and the papers, a magnitude of the friction being determined by the friction coefficient.

In the paper separating guide according to the embodiment of the present invention, even when a thick printing paper is used, a picking error does not occur. Furthermore, even when a thin printing paper is used, multiple papers are not fed at one time, so that it is possible to use various types of papers.

BRIEF DESCRIPTION OF THE DRAWINGS

These and/or other objects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
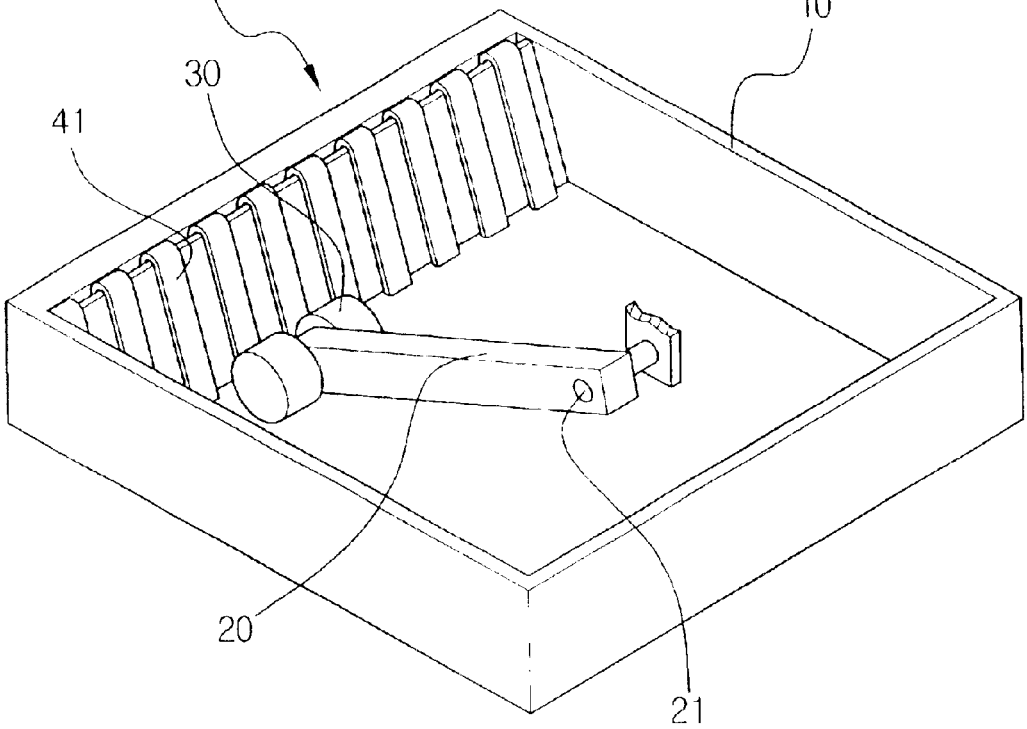
FIG. 1 (PRIOR ART)
FIG. 1 is a perspective view illustrating a paper feeding cassette for a printing apparatus having a conventional paper separating guide.
Figure 2:
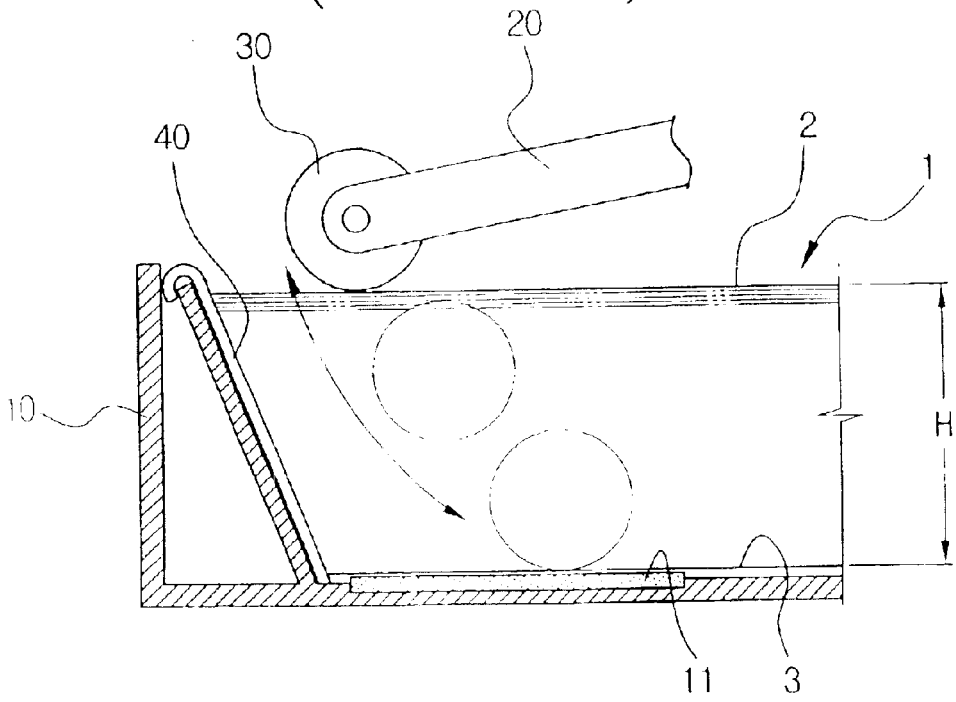
FIG. 2 (PRIOR ART)
FIG. 2 is a view illustrating a track of a pick-up roller which is changed based on a stacked height of a printing paper in the paper feeding cassette of FIG. 1.
Figure 3:
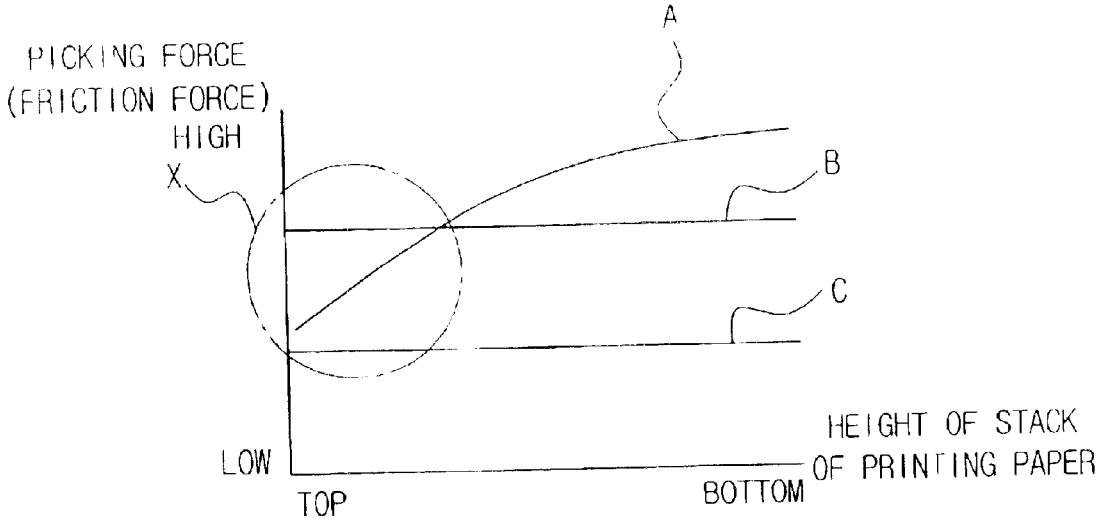
FIG.3 (PRIOR ART)
FIG. 3 is a graph for describing a change of a picking force based on a position of the pick-up roller in the paper feeding cassette of FIG. 2.

Reference will now be made in detail to the present preferred embodiment of the present invention, an example of which is illustrated in the accompanying drawings, wherein like reference numerals refer to like elements throughout.

Figure 4:
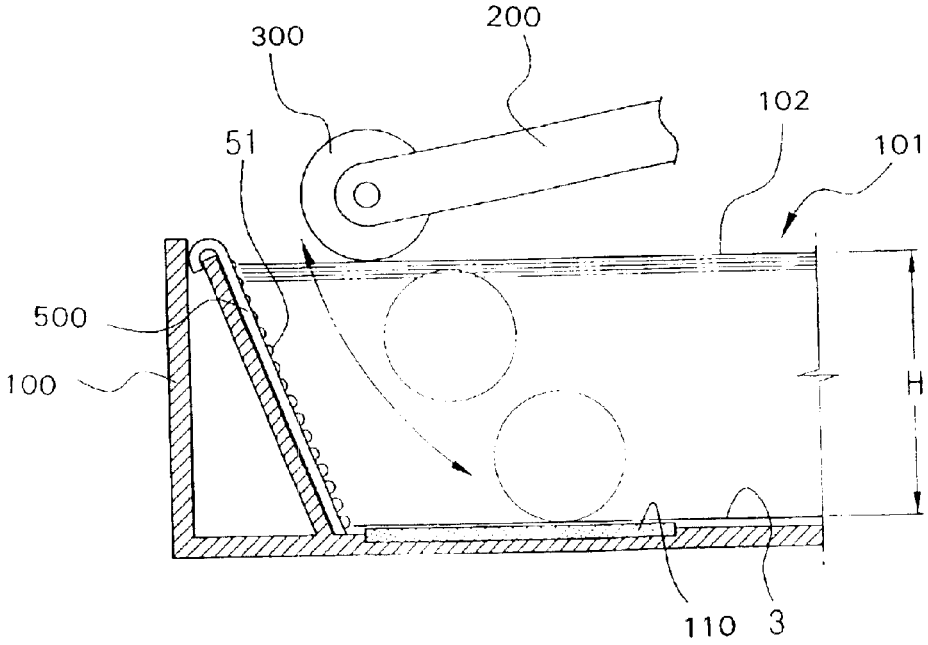
FIG. 4 is a cross-sectional view illustrating a paper feeding cassette for a printing apparatus having a paper separating guide according to an embodiment of the present invention.

As shown in FIG. 4, the paper feeding cassette for a printing apparatus according to an embodiment of the present invention includes a cassette 100, a pick-up roller 300, a picking arm 200 and a paper separating guide 500.

The cassette 100 stacks a plurality of printing papers 101 therein and is installed in a body (not shown) of the printing apparatus. A pad 110 is provided in a bottom of the cassette 100 to transfer a last printing paper 102.

The pick-up roller 300 is installed in an upper portion of the cassette 100 and puts pressure on the printing papers 101 stacked in the cassette 100, and rotates to thereby transfer the printing papers 101 in a direction of the paper separating guide 500.

The picking arm 200 is installed in such a manner that one end thereof (not shown) is rotatable with respect to the body of the printing apparatus, and the other end is connected to a shaft of the pick-up roller 300. Therefore, when the height H of the printing papers 101 stacked in the cassette 100 is changed, since the pick-up roller 300 is rotated with respect to the end of the picking arm 200, the pick-up roller 300 is capable of continuously putting pressure on the printing papers 101. In addition, the picking arm 200 includes a driving force transferring unit (not shown) to receive a driving force from a driving source (not shown), such as a motor installed in the body and to transfer the force to the pick-up roller 300. Therefore, the pick-up roller 300 rotates in a state in which the printing papers 101 receive pressure.

Figure 6:
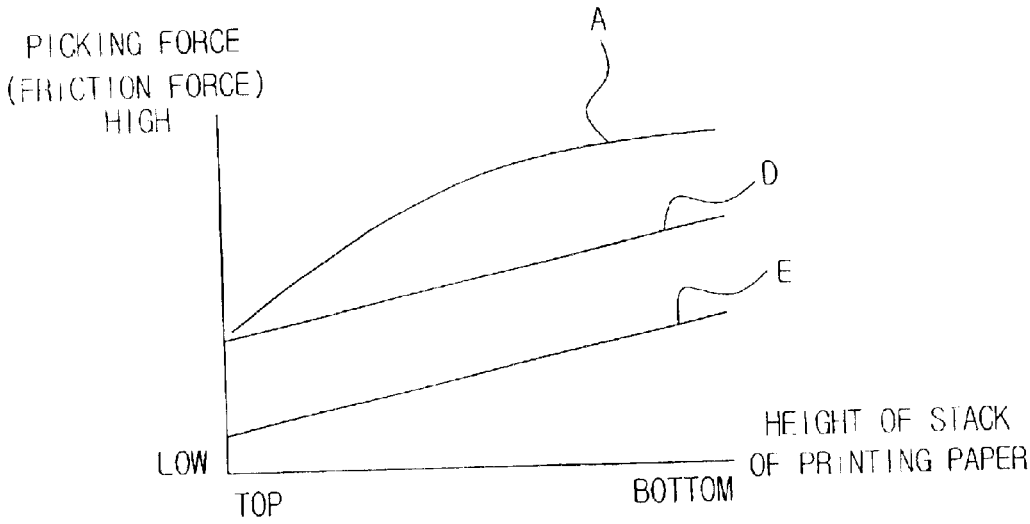
FIG. 6 is a view illustrating an example of a change of a friction force based on a stacked height of a printing paper of the paper separating guide of FIG. 4.
Figure 7:
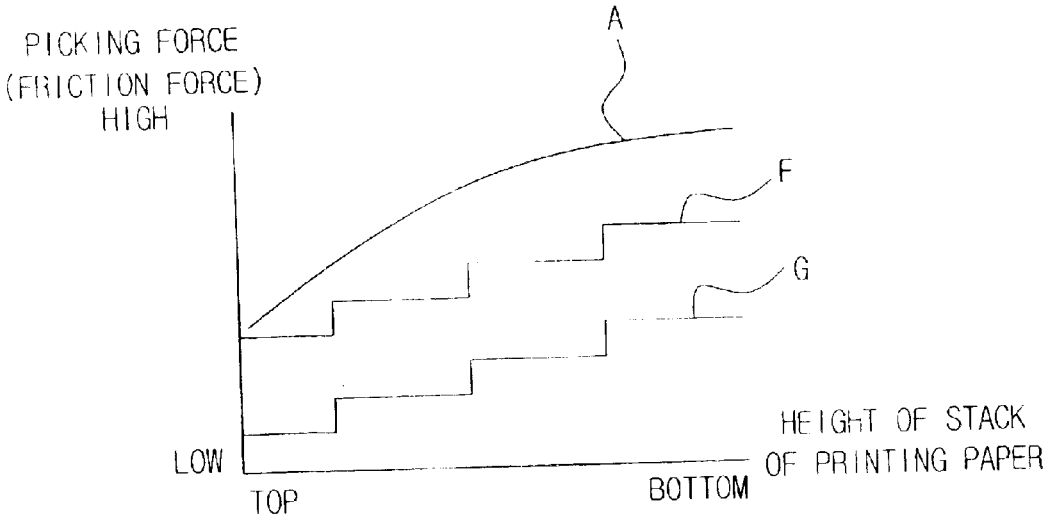
FIG. 7 is a view illustrating another example of a change of a friction force based on a stacked height of a printing paper of the paper separating guide of FIG. 4.

The paper separating guide 500 is installed in the forward part of the cassette 100 and is installed in such a manner that the paper separating guide 500 is inclined at a certain angle with respect to the cassette 100. The surface of the paper separating guide 500 is formed in such a manner that a friction coefficient may differ based on the contact position of the printing papers 101, namely, the stacked height H of the printing papers. In certain instances, a surface friction coefficient of the paper separating guide 500 is linearly changed based on the position of the printing papers 101 (FIG. 6). However, as shown in FIG. 7, in other instances, a constant friction coefficient may be formed at a regular interval, namely, in a step shape. At this time, the surface friction coefficient of the paper separating guide 500 is formed in such a manner that the friction coefficient of the portion contacting the printing paper 103 positioned at the bottom of the cassette 100 is maximized.

Figure 5A:
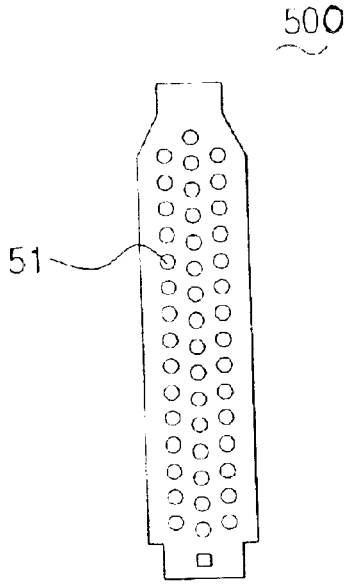
FIGS. 5A and 5B are a plan view and side view, respectively, illustrating the paper separating guide of FIG. 4.
Figure 5B:
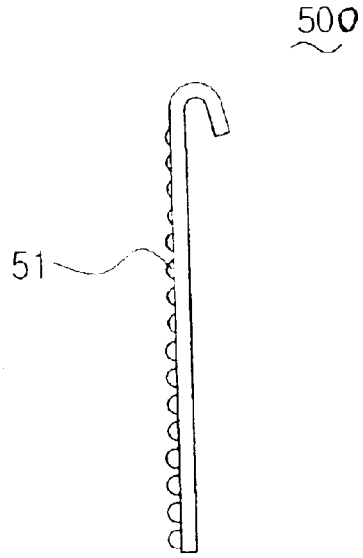

There may be various methods to change the surface friction coefficient of the paper separating guide 500. For example, a plurality of small protrusions 51 are formed on a surface of the paper separating guide 500. As shown in FIGS. 5A and 5B, a largest protrusion is formed at a lower side of the paper separating guide 500. The sizes of the protrusions 51 are sequentially decreased at a regular interval to thereby decrease the friction coefficients.

The operation of the paper separating guide 500 will now be described with reference to FIG. 4.

When a printing operation starts, a driving force is transferred to the pick-up roller 300 through the picking arm 200. At the same time, the picking arm 200 is rotated downward with respect to the engaging portion of the body of the printing apparatus, and the pick-up roller 300 pressurizes an upper surface of the uppermost printing paper 102, which is positioned in the cassette 100. Although not shown in FIG. 4, the engaging portion is similar to that shown in FIG. 1.

Therefore, the uppermost printing paper 102 is transferred to the paper separating guide 500 by a friction force of the pick-up roller 300 and a transferring force based on the rotation of the same. At this time, a plurality of the printing papers 101 are transferred in a direction of the paper separating guide 500 by the pick-up roller 300. However, only the uppermost printing paper 102, in which the transferring force is larger than the friction force is transferred to the body of the printing apparatus through the paper separating guide 500. However, since the transferring forces of the printing papers placed below the uppermost printing paper 102 are smaller than the friction force, these papers do not pass through the paper separating guide 500. Therefore, the printing papers 101 of the paper stack in the cassette 100 are separated sheet by sheet, and thus, each separated printing paper sheet is transferred to the body of the printing apparatus.

At this time, if a maximum amount of the thickest printing paper is stacked in the cassette, a picking error does not occur as opposed to the conventional paper separating guide.

FIG. 6 shows the change of the friction force by the paper separating guide 500 (lines D and E) according to the height of the paper stack and a change of the transfer force (picking force) of a printing paper by the pick-up roller 300 (line A), based on an assumption that papers in thickness varying from maximum 105 g/m$^2$ to minimum 60 g/m$^2$ are used. In FIG. 6, line D represents a friction force curve of the thick printing paper (105 g/m$^2$), and E represents a friction force curve of a thin printing paper (60 g/m$^2$). As shown in FIG. 6, since the friction force by the paper separating guide 50 with the thick printing papers in the highest stack is smaller than the picking force of the pickup roller 300, a picking error does not occur.

When the printing papers 101 are continuously fed, the stacked height H of the printing papers is gradually decreased. Therefore, the picking arm 200 is rotated in a lower direction based on the stacked height H of the printing paper, and the pick-up roller 300 transfers the printing paper 101 to the paper separating guide 500.

Even if the stacked height H of the printing papers 101 is decreased, then the picking force of the pick-up roller 300 is increased, the friction coefficient of the paper separating guide 500 is increased, and the friction force applied to the printing papers 101 is increased, so that papers still can be fed one by one and there is no multi-feed of paper.

Therefore, with the paper separating guide 500 according to the embodiment of the present invention, the picking error is prevented when the thick printing papers are in use, and the simultaneous feeding of multiple sheets of printing paper is also prevented when the thin printing papers are in use.

Although a preferred embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A paper separating guide installed in a paper feeding cassette, to separate printing papers stacked in the paper feeding cassette sheet by sheet, the paper separating guide comprising:

a surface having a friction coefficient which varies at a regular interval depending on contact positions of leading ends of the printing papers.

2. A paper separating guide installed in a paper feeding cassette, to separate printing papers stacked in the paper feeding cassette sheet by sheet, the paper separating guide comprising:

a surface having a friction coefficient which varies depending on contact positions of leading ends of the printing papers, wherein said friction coefficient linearly varies depending on the contact positions.

3. The guide of claim 1, wherein said friction coefficient varies step by step depending on the contact positions.

4. The guide of claim 1, wherein said friction coefficient is largest at a bottom of the paper feeding cassette.

5. The guide of claim 4, wherein a minimum value of the friction coefficient is smaller than a force needed to transfer an uppermost one of the printing papers.

6. The guide of claim 5, wherein the surface of the paper separating guide comprises a plurality of protrusions, and said friction coefficient is determined based on heights of the protrusions.

7. A paper feeding cassette for a printing apparatus, comprising:

a cassette to stack a plurality of printing papers therein;

a paper separating guide which is installed in the cassette and has a surface friction coefficient which varies at a regular interval based on contact positions of the printing papers; and a pick-up roller which is rotated based on a height of the stacked printing papers, wherein the printing papers are transferred to the paper separating guide by the rotation of the pick-up roller by being separated one by one by a friction between the paper separating guide and the papers, a magnitude of the friction being determined by the friction coefficient.

8. The cassette of claim 7, wherein said friction coefficient is varied step by step depending on the contact positions of the printing papers.

9. The cassette of claim 7, wherein said friction coefficient is greatest at a bottom of the cassette.

10. The cassette of claim 9, wherein a minimum value of the friction coefficient is smaller than a force needed to transfer an uppermost one of the printing papers.

11. The cassette of claim 10, wherein the paper separating guide comprises protrusions, wherein said friction coefficient is determined based on heights of the protrusions formed in the paper separating guide.

12. A paper feeding cassette for a printing apparatus, comprising:

a cassette to stack a plurality of printing papers therein;

a paper separating guide which is installed in the cassette and has a variable surface friction coefficient based on contact positions of the printing papers; and a pick-up roller which is rotated based on a height of the stacked printing papers, wherein the printing papers are transferred to the paper separating guide by the rotation of the pick-up roller by being separated one by one by a friction between the paper separating guide and the papers, a magnitude of the friction being determined by the friction coefficient, wherein said friction coefficient is linearly varied depending on the contact positions of the printing papers.

13. An apparatus to transfer a plurality of papers, comprising:

a cassette, the papers being stacked therein; and a paper separating guide installed in the cassette in contact with the papers, a friction coefficient between the papers and the paper separating guide varying based on positions of the papers, wherein the friction coefficient varies linearly.

14. An apparatus to transfer a plurality of papers, comprising:

a cassette, the papers being stacked therein; and a paper separating guide installed in the cassette in contact with the papers, a friction coefficient between the papers and the paper separating guide varying at a regular interval based on positions of the papers.

15. The apparatus of claim 14, wherein the cassette comprises a pad, and a lowermost one of the papers is stacked on the pad.

16. The apparatus of claim 14, wherein the paper separating guide is disposed at an angle with respect to the papers.

17. The apparatus of claim 14, wherein the friction coefficient varies in a step shape.

18. The apparatus of claim 14, wherein the friction coefficient is maximized at a bottom of the stacked papers.

19. The guide of claim 14, wherein the protrusions have three sizes.

20. The apparatus of claim 14, further comprising:

a pick-up roller in contact with an uppermost one of the papers to rotate and thereby separate the uppermost paper from the remaining papers.

21. The apparatus of claim 20, wherein the pick-up roller pressurizes the papers, and a friction force is generated between the pick-up roller and the uppermost paper.

22. The apparatus of claim 21, wherein the pick-up roller transfers the uppermost paper to the paper separating guide due to the friction therebetween.

23. The apparatus of claim 22, wherein the pick-up roller transfers only the uppermost paper to the paper separating guide.

24. The apparatus of claim 23, wherein the friction between the pick-up roller and the uppermost paper is greater than a friction created between the remaining papers and the paper separating guide due to the friction coefficient.

25. The apparatus of claim 14, wherein the paper separating guide comprises protrusions having varying sizes, wherein the friction coefficient varies based upon the sizes of the protrusions.

26. The apparatus of claim 25, wherein the protrusion having the greatest size is formed on a lowest side of the paper separating guide.

27. The apparatus of claim 26, wherein the sizes of the protrusions are sequentially decreased at a regular interval.

28. A printing apparatus, comprising:

a main body, and a feeder in contact with the main body, the feeder comprising:

a cassette to stack a plurality of printing papers therein, a paper separating guide installed in the cassette and has a surface friction coefficient which varies gradually based on contact positions of the printing papers, and a pick-up roller which is rotated based on a height of the stacked printing papers, wherein the printing papers are transferred to the paper separating guide by the rotation of the pick-up roller by being separated one by one by a friction between the paper separating guide and the printing papers, a magnitude of the friction being determined by the friction coefficient.

29. The apparatus of claim 28, wherein said friction coefficient is greatest at a bottom of the cassette.

30. The apparatus of claim 28, wherein a minimum value of the friction coefficient is smaller than a force needed to transfer an uppermost one of the printing papers.

31. The apparatus of claim 28, wherein the paper separating guide comprises protrusions, wherein said friction coefficient is determined based on heights of the protrusions formed in the paper separating guide.

* * * * *